US005865600A

United States Patent [19]

Mori et al.

[11] Patent Number: 5,865,600

[45] Date of Patent: Feb. 2, 1999

[54] GAS TURBINE ROTOR

[75] Inventors: Masahiko Mori; Toru Tsukakoshi, both of Takasago, Japan

[73] Assignee: Mitsubishi Heavy Industries, Ltd., Tokyo, Japan

[21] Appl. No.: 862,161

[22] Filed: May 22, 1997

[51] Int. Cl.[6] ..... F01D 5/06

[52] U.S. Cl. ..... 416/198 A; 416/201 R; 415/135; 415/136; 415/170.1; 415/174.2; 277/643; 277/649

[58] Field of Search ..... 416/198 A, 199, 416/200 A, 201 R, 95, 193 A; 415/135, 136, 138, 170.1, 174.2; 277/548, 566, 643, 644, 649

[56] References Cited

U.S. PATENT DOCUMENTS

| | | | |
|---|---|---|---|
| 2,898,000 | 8/1959 | Hanny | 277/649 |
| 3,542,380 | 11/1970 | Klein et al. | 277/649 |
| 3,745,628 | 7/1973 | Stahl | 416/200 A |
| 3,801,220 | 4/1974 | Beckershoff | 416/198 A |
| 3,975,114 | 8/1976 | Kalkbrenner | 415/138 |

OTHER PUBLICATIONS

U.S. Application No. 08/862,135, Masahiko Mori et al., filed May 22, 1997.

U.S. Application No. 08/862181, Masanori Yuri et al., filed May 22, 1997.

U.S. Application No. 08/861,517, Eiji Akita et al., filed May 22, 1987.

U.S. Application No. 08/861,539, Kenichiro Takeishi et al., filed May 22, 1997.

U.S. Application No. 08/861,753, Yasuoka Tomita et al., filed May 22, 1997.

U.S. Application No. 08/861,518, Yukihiro Hashimoto, filed May 22, 1997.

*Primary Examiner*—Christopher Verdier

*Attorney, Agent, or Firm*—Wenderoth, Lind & Ponack, L.L.P.

[57] ABSTRACT

A baffle plate (12A) is constructed such that two belt-like elements, bent in a warped arc, are joined by spot welding (13) or brazing (14) at a central portion thereof along a central circumferential portion. Thus, even if there is a difference in a radial directional deflection of grooves (11) between adjacent discs (9), the baffle plate (12A) will maintain close contact with the inner surfaces of the grooves (11) due to a spring effect and gas leakage is thereby prevented.

4 Claims, 4 Drawing Sheets

GAS TURBINE ROTOR

BACKGROUND OF THE INVENTION

1. Field of the Invention

The present invention relates to a gas turbine rotor, and more specifically to a sealing structure for rotor discs.

2. Description of the Prior Art

FIG. 4 is a conceptual view showing a general construction of a gas turbine, FIG. 5 is a longitudinal cross sectional view showing one example of the construction of a prior art gas turbine rotor, and FIG. 6 is an enlarged perspective view showing a construction of portion VI of FIG. 5.

As illustrated in FIG. 4, the gas turbine is so constructed that air is compressed at a compressor (1) and fuel is fed into a combustor (2) in order to generate a combustion gas, which is introduced into a turbine portion (3) to rotate a generator (4). A rotor of the turbine portion (3) consists of a plurality of discs (9), as shown in FIG. 5. In order to prevent cooling air (6) in a rotor interior (5) from flowing out into a gas path (7) of the turbine portion as well as to prevent a high temperature gas (8), flowing in the gas path (7) of the turbine portion, from flowing into the rotor interior (5), as shown in FIG. 6, there is provided an annular projection (10) on each surface of the disks adjoining each other so that the annular projections (10) face or oppose each other and surround a rotational axis of the rotor. A groove (11) is provided on or formed in a tip surface of the respective projection (10), and a seal plate or baffle plate (12), which is sectioned into two pieces or four pieces in the circumferential direction, is inserted into the respective groove (11). The baffle plate (12) is pushed to a radial outer side of the groove (11) by a centrifugal force due to rotation so as to effect a seal.

In the prior art rotor disks, it is intended to effect a seal by pressing the baffle plate into engagement with the radial outer side of the groove provided at the projection of the disc by a centrifugal force due to rotation. However, as there is a temperature difference between the discs, a difference in elongation occurs in a radial direction of the groove. There is also a difference in elongation in the radial direction due to a centrifugal force between the discs. As the baffle plate is rigid, it will no longer maintain uniform pressing contact with the outer side of the groove, and minute gaps are created between the groove and the baffle plate. Thus, there is a fear that the cooling air in the rotor interior may flow out into the gas path of the turbine portion, or that the high temperature gas flowing in the gas path of the turbine portion may flow into the interior of the rotor. There is also a concern that the baffle plate may cause a self-induced vibration due to flow leaking from the minute gaps, causing an abrasion loss.

SUMMARY OF INVENTION

It is therefore an object of the present invention to provide a gas turbine rotor which is free from such shortcomings seen in the prior art gas turbine rotors.

In order to attain the object, the present invention discloses a gas turbine rotor in which an annular projection is provided on each of adjacent surfaces of a plurality of rotor discs so as to face each other surrounding a rotational axis of the rotor. A groove is provided on a tip surface of the respective annular projections and a baffle plate consisting of two belt-like elements, joined at a central portion in the circumferential direction, is inserted into the grooves which face or oppose each other.

The baffle plate employed for the gas turbine rotor according to the present invention may be constructed, for ease of manufacture, such that the two belt-like elements are joined at a central portion along the longitudinal direction with both side portions of the two belt-like elements being bent to form curved surfaces.

As an alternative to the two belt-like elements, the baffle plate employed for the gas turbine rotor according to the present invention may be constructed of one plate element in order to provide superior strength characteristics. The one plate element has slits formed from central portions of both side portions of the plate element toward a center of the plate element. Stop holes are formed at inner terminal ends of the slits is worked to be bent.

According to the present invention, as mentioned above, a baffle plate consisting of two belt-like elements joined at a central portion in a circumferential direction is employed, thereby the baffle plate has a spring effect. Thus, the baffle plate is inserted into the respective grooves and conforms to inner peripheral surfaces thereof so as to prevent gas leakage, even if there is a difference in a radial directional deflection of the grooves between the adjacent discs. Further, minute gaps between the groove and the baffle plate can be eliminated completely, and thereby leakage of gas will not occur through gaps. Also, self-induced vibration of the baffle plate is prevented. As the result, there is no concern regarding abrasion loss of the baffle plate.

BRIEF DESCRIPTION OF THE DRAWINGS

FIG. 3*a* is a perspective view showing the construction of the baffle plate employed in the arrangement shown in FIG. 2, and FIG. 3*b* is a perspective view illustrating an alternate construction of the baffle plate which can be employed in the arrangement shown in FIG. 2.

DESCRIPTION OF THE PREFERRED EMBODIMENTS

Figure 5:
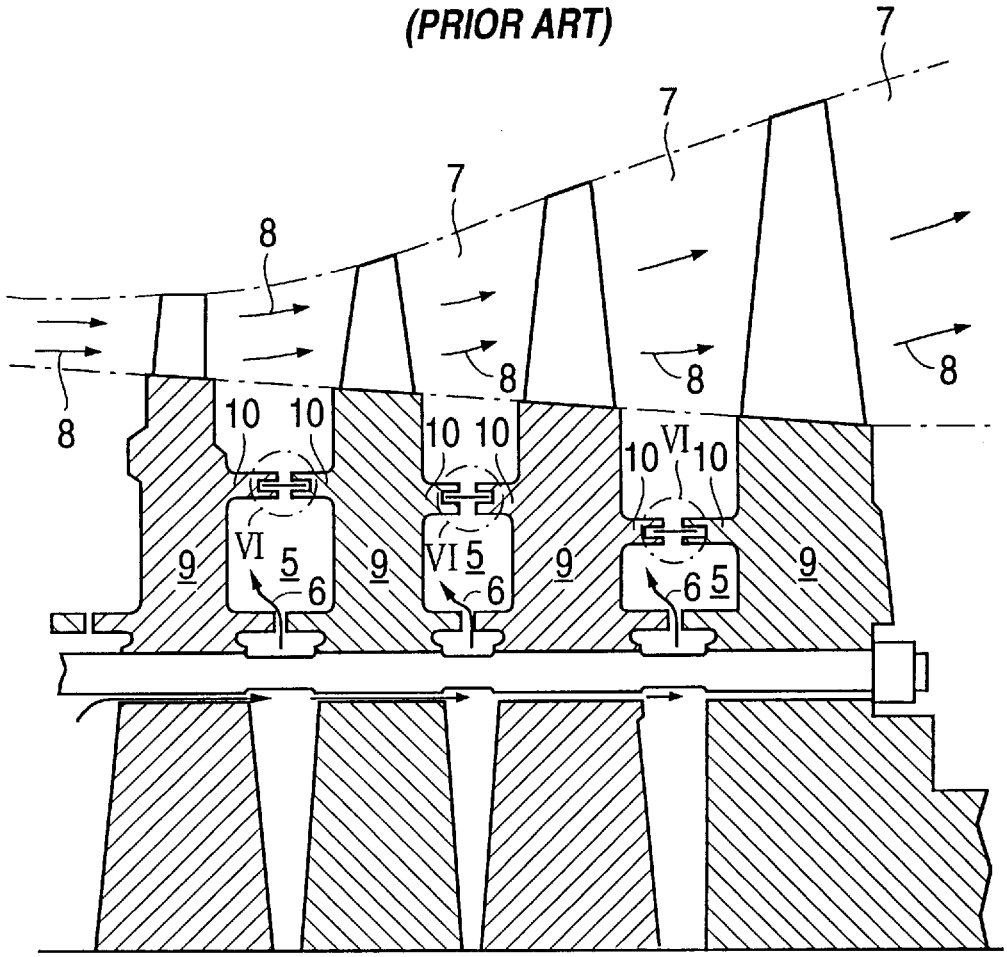
FIG. 5 (PRIOR ART)
FIG. 5 is a longitudinal cross sectional view showing one example of a prior art gas turbine rotor.
Figure 6:
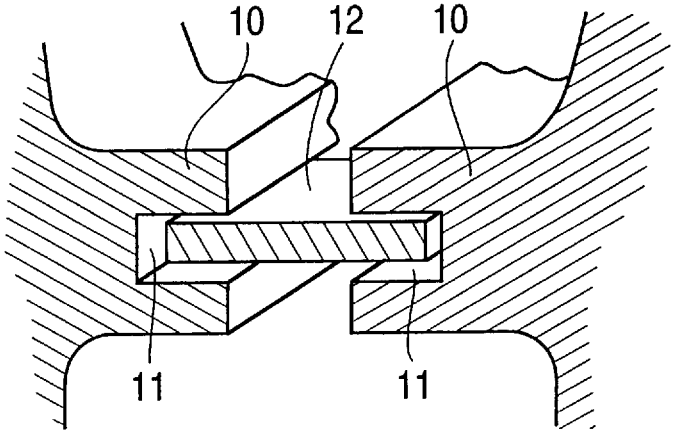
FIG. 6 (PRIOR ART)
FIG. 6 is an enlarged perspective view of portion of VI of FIG. 5

The following is a description of a gas turbine rotor according to the present invention based on the preferred embodiments illustrated in FIGS. 1 to 3*b*. Incidentally, portions of the constructions in the preferred embodiments which are the same as or similar to those in the prior art arrangements, shown in FIGS. 5 and 6, are denoted with the same numerals for simplicity and repeated description thereof is omitted.

Figure 1:
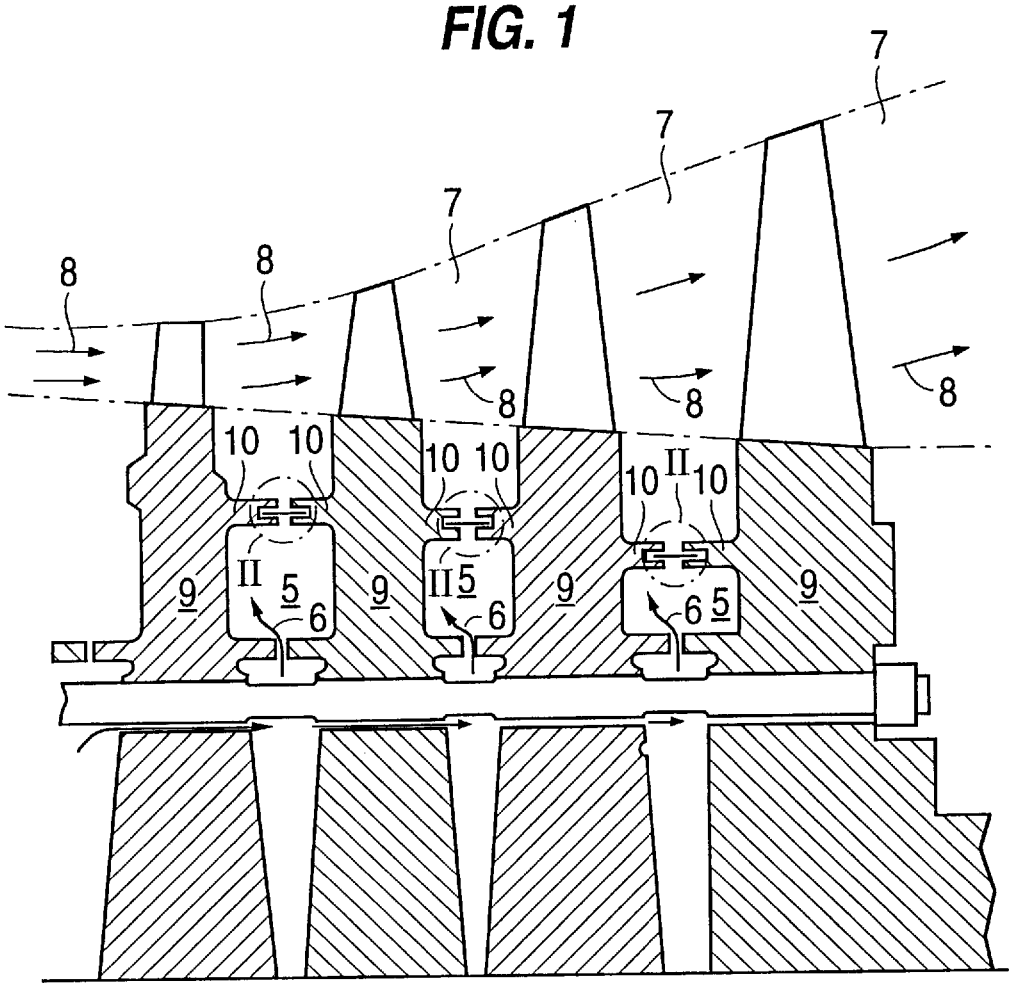
FIG. 1 is a longitudinal cross sectional view showing a structure of a gas turbine rotor of one preferred embodiment according to the present invention.
Figure 2:
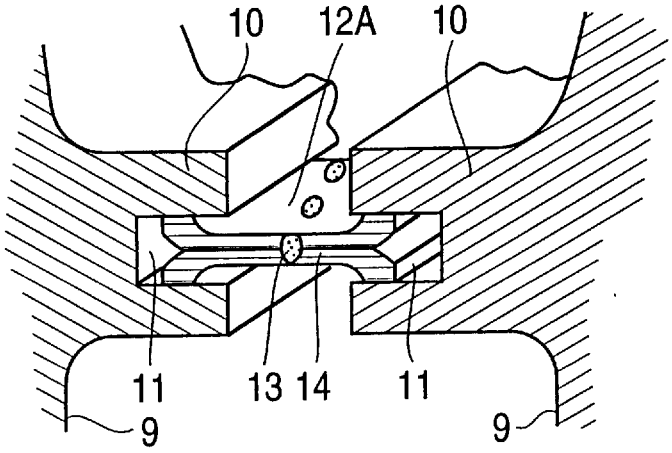
FIG. 2. is an enlarged perspective view showing a structure of portion II of FIG. 1.
Figure 3A:
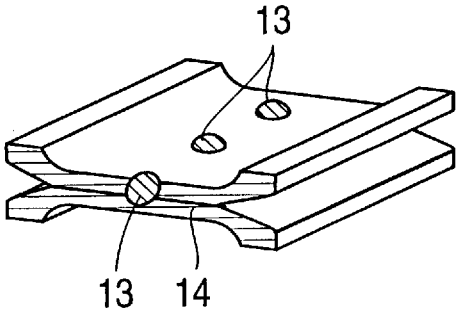
FIGS. 3*a*–3*b* are perspective views, in particular.
Figure 3B:
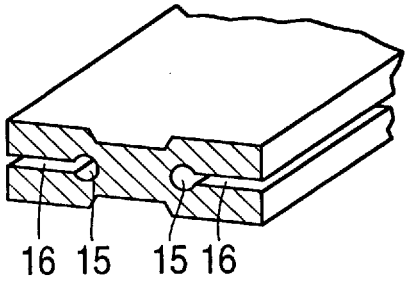
Figure 4:
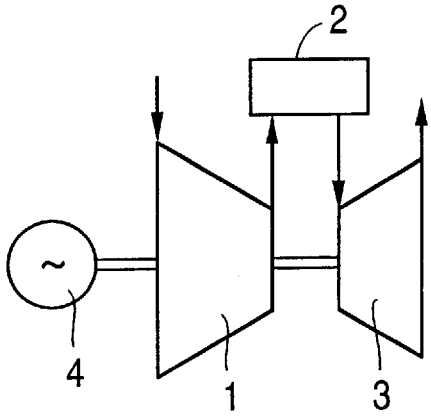
FIG. 4 (PRIOR ART)
FIG. 4 is a conceptual view showing a general structure of a conventional gas turbine.

FIG. 1 is a longitudinal cross sectional view showing a gas turbine rotor of one preferred embodiment according to the present invention. FIG. 2 is an enlarged perspective view showing portion II of FIG. 1, and FIGS. 3*a*–3*b* are perspective views showing examples of the baffle plate structure of FIG. 2.

A turbine rotor shown in FIG. 1 includes a plurality of discs (9). An annular projection (10) is provided on each of adjacent surfaces of the discs so as to face or oppose each other around a rotational axis of the rotor. A groove (11) is provided on a surface of the tips of the respective projections (10), similar to that in the prior art described above.

In the preferred embodiments, a baffle plate is inserted into the grooves (11), which face or confront each other. The baffle plate (12A) includes two belt-like elements joined at a central longitudinal portion about the circumference of each belt-like element. More specifically, the baffle plates shown in FIGS. 2 and 3(*a*) are constructed of two thin plate elements, which are each bent in a warped arc so as to have a concave side surface and a convex side surface. The plate elements are joined at a central portion by spot welding (13) or brazing (14) and are sectioned into two pieces or four pieces. Also, the baffle plate shown in FIG. 3(*b*) is constructed with one plate element having slits (16) formed by cutting etc. from central portions along both side portions of the plate element toward a center of the plate elements. Stop holes (15) are formed at inner terminal ends of the slits, and the plate element is worked so as to be bent. The former baffle plates are easier to manufacture, while the latter baffle plates exhibit superior strength characteristics.

As the prior art baffle plate is relatively rigid, if there is a difference in the radial directional deflection of the grooves at the annular projections between the discs, there will occur minute gaps between the groove and the baffle plate so that a gas leakage will occur. Thus, there is a fear that the baffle plate, will undergo a self-induced vibration, which causes abrasion loss of the plate.

According to the present invention, the gas turbine rotor employs a baffle plate which includes two belt-like elements joined along central circumferential portions thereof so as to have a spring effect. Therefore, no gaps will occur between the groove and the baffle plate, even if there is a difference in the radial directional deflection of the grooves between adjacent discs. Accordingly, there occurs no leakage of a sealed gas nor self-induced vibration of the baffle plate. As the result, an abrasion loss of the baffle plate can be prevented.

While the preferred form of the present invention has been described, variation thereto will occur to those skilled in the art within the scope of the present inventive concepts which are delineated by the following claims.

What is claimed is:

1. A gas turbine rotor comprising:

a plurality of adjacent rotor discs, wherein adjacent discs of said plurality of discs have opposing annular projections which surround a rotational axis of said gas turbine rotor, and each of said annular projections has a tip portion and a groove formed in said tip portion so as to oppose said groove formed in said tip portion of said annular projection of said adjacent disc; and a baffle plate inserted in said grooves of said opposing annular projections, said baffle plate including:

a first belt-like element having a generally concave side surface and an opposite generally convex side surface; and a second belt-like element having a generally concave side surface and an opposite generally convex side surface, wherein said first and second belt-like elements are connected along a central portion of said convex surfaces of said first and second belt-like elements such that peripheral edge portions of said first and second belt-like elements are in continuous engagement with inner peripheral surfaces of said associated grooves.

2. The gas turbine rotor as claimed in claim 1, wherein said first and second belt-like elements are connected by spot welds.

3. A gas turbine rotor comprising:

a plurality of adjacent rotor discs positioned along a central rotational axis of said gas turbine rotor;

an annular projection provided on opposing lateral surfaces of adjacent discs of said plurality of rotor discs, each of said annular projections having a tip portion defining a groove; and a baffle plate inserted in said grooves of said opposing annular projections, said baffle plate comprising a plate element having a first peripheral edge portion, a second peripheral edge portion, a first slit formed in a central portion of said first peripheral edge portion, a second slit formed in a central portion of said second peripheral edge portion, wherein each of said first and second annular slits extends towards a center of said baffle plate and has an inner end which forms a stop hole.

4. The gas turbine rotor as claimed in claim 3, wherein said outer peripheral edge portions of said baffle plate are bent outwardly relative to a central portion of said baffle plate.

* * * * *